US010930201B1

(12) United States Patent
Baroughi et al.

(10) Patent No.: US 10,930,201 B1
(45) Date of Patent: Feb. 23, 2021

(54) MICRO LIGHT EMITTING DIODE TESTING

(71) Applicant: Apple Inc., Cupertino, CA (US)

(72) Inventors: Mahdi Farrokh Baroughi, Santa Clara, CA (US); Bo Yang, Santa Clara, CA (US); Xiang Lu, Campbell, CA (US); Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 332 days.

(21) Appl. No.: 15/910,906

(22) Filed: Mar. 2, 2018

Related U.S. Application Data

(63) Continuation of application No. 15/713,140, filed on Sep. 22, 2017, now abandoned.

(60) Provisional application No. 62/398,696, filed on Sep. 23, 2016.

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2300/0452* (2013.01); *G09G 2330/08* (2013.01); *G09G 2330/12* (2013.01)

(58) Field of Classification Search
None
See application file for complete search history.

(56) References Cited

U.S. PATENT DOCUMENTS

2012/0028375 A1* 2/2012 Sato ..... H01L 33/0095 438/4
2014/0240304 A1* 8/2014 In ..... G09G 3/3233 345/212
2014/0267683 A1* 9/2014 Bibl ..... G09G 3/006 348/87
2015/0153031 A1* 6/2015 Myers ..... F21V 21/005 362/612

* cited by examiner

*Primary Examiner* — Jas A Sanghera
(74) *Attorney, Agent, or Firm* — Fletcher Yoder P.C.

(57) ABSTRACT

Methods and systems for testing a display having an array of microdrivers arranged in multiple of rows and columns including setting a testing mode of a microdriver of the array of microdrivers using multiple pins of the microdriver that are used in scanning or operation modes of the microdriver. The microdriver is configured to light one or more connected micro light emitting diode pixels coupled to the microdriver during the testing mode. Testing also includes operating the microdriver in the testing mode and determining functionality of the one or more connected micro light emitting diode pixels or the microdriver based on the testing mode.

18 Claims, 11 Drawing Sheets

MICRO LIGHT EMITTING DIODE TESTING

CROSS REFERENCE TO RELATED APPLICATIONS

This application is a continuation of U.S. application Ser. No. 15/713,140, filed Sep. 22, 2017, which claims the benefit of U.S. Provisional Application No. 62/398,696, filed Sep. 23, 2016, the contents of which are herein expressly incorporated by reference for all purposes.

BACKGROUND

The present disclosure relates generally to techniques for testing a display and, more particularly, to techniques for testing an electrically configurable display panel including micro light emitting diodes (μLEDs).

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Most modern electronic devices, such as computer monitors, televisions, vehicle infotainment systems, smart phones, and smart watches, utilize flat panel displays. Traditionally, most flat panel displays have employed liquid crystal display (LCD) technology. Although specific designs vary, LCDs typically include a layer of liquid crystal molecules disposed between two transparent electrodes and two polarizing filters. By controlling the voltage applied across the liquid crystal layer for each pixel, light can be allowed to pass through in varying amounts. Because the LCD pixels produce no light of their own, LCDs typically use a backlight, such as a fluorescent lamp or an array of light emitting diodes (LEDs) to produce a visible image. Advantageously, LCDs are relatively compact, inexpensive, easy to operate, and can be made in almost any size. However, disadvantageously, LCDs tend to have a limited viewing angle, relatively poor black levels because the liquid crystals cannot completely block all the light from passing through, uneven backlighting, and are relatively difficult to read in sunlight.

More recently, displays using organic light emitting diodes (OLED) have been replacing the more traditional flat panel displays. OLED displays use LEDs that include an emissive electroluminescent layer made from an organic compound that emits light in response to an electric current. Because an OLED display emits its own light and, thus, works without a backlight, it can display darker black levels and can be thinner and lighter than a comparable LCD.

μLED displays are an emerging flat panel display technology. μLED displays include arrays of microscopic arrays of LED that form individual pixel or subpixel elements. As compared to LCD and OLED technology, μLED displays offer greater contrast, faster response times and less energy consumption. Further, μLED displays are easier to read in direct sunlight and do not suffer from the shorter lifetimes of OLED displays. However, electrically configurable displays (such as μLED displays) use active matrixes of μLEDs, pixel drivers (commonly referred to as microdrivers), and arrays of row and column drivers all integrated on a routing backplane in a hybrid fashion. While this hybrid approach enables integration of state of the art technologies for μLEDs, microdrivers, and row and column drivers to yield a superior display technology, the approach relies on pick-and-place and bonding technologies that are prone to certain placement and bonding imperfections. The techniques disclosed herein are directed to addressing some of these concerns.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
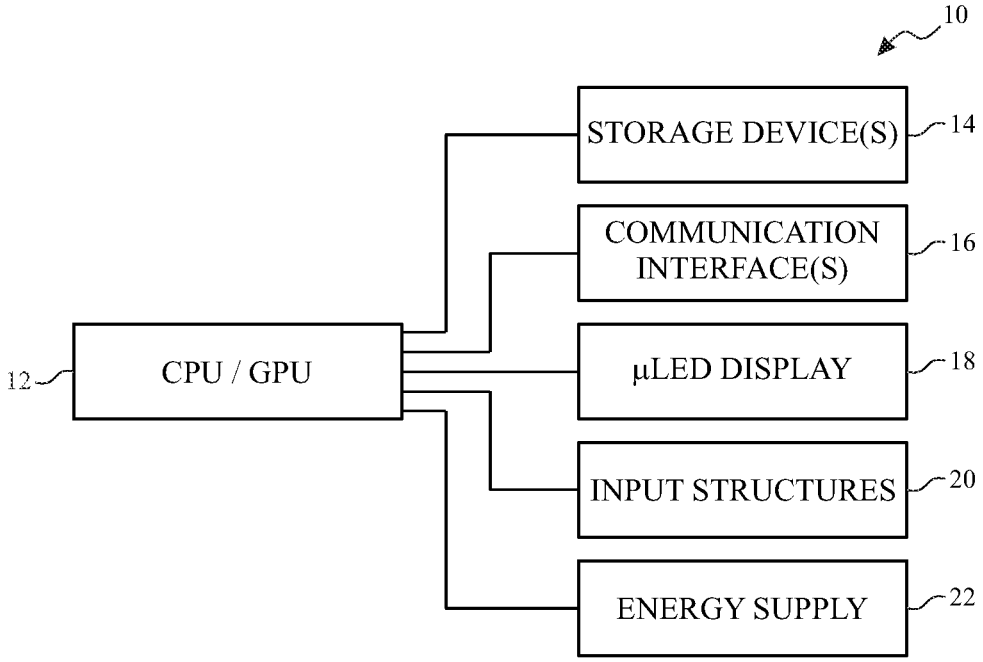
FIG. 1 is a block diagram of components of an electronic device that may include a micro-light-emitting-diode (μ-LED) display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, μLED displays utilize display technologies that are superior to LCD and OLED displays in many ways. Nevertheless, because μLED displays rely upon pick-and-place and bonding technologies, the fabrication of μLED displays is prone to certain placement and bonding imperfections. Hence, current μLED displays are manufactured with redundant μLEDs, redundant microdrivers (μDs), and redundant column and row drivers, all of which then must be tested to determine if any defective elements exist. If so, some of the redundant components are activated and utilized. Unfortunately, known testing techniques require that all known components of the μLED display, including the μLEDs, μDs, and row and column drivers, be fabricated onto the display panel before any testing occurs. As a result, the cost of any unused components unnecessarily leads to additional cost of the μLED display. Furthermore, known testing techniques are performed in a serial fashion and, thus, can only identify whether a row under test includes a defective μD, but cannot pinpoint which μD is defective.

The present techniques described below are capable of identifying and pinpointing defective μDs and row/column drivers either before or after any μLEDs have been placed on the display. Using the architectures described below, each data line of the μLEDs, which is typically a unidirectional digital line in digital displays used for the transfer of RGB gray levels and driver configuration bits, may instead be a bidirectional digital line with an additional function of transferring the test output sequences upstream to the timing control (TCON) and/or into the main board. This upstream data flow can include information about the pin connectivity and the functional state of the μDs. Such data collection is a relatively fast process, since the test data is collected from all the μDs in the row under test in a parallel manner. As such, this yields access to the output of every μD in the active row, which allows for the identification of specific defective μDs. Furthermore, the data lines may not only carry information about pin connectivity and functional state of the μDs, they may also contain information about the pin connectivity and function state of the active row driver in the row driver under test. As a result, the present techniques enable the detection and identification of specific defective row drivers as well.

Suitable electronic devices that may include a micro-LED (μ-LED) display and corresponding circuitry of this disclosure are discussed below with reference to FIGS. 1-4. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

Figure 2:
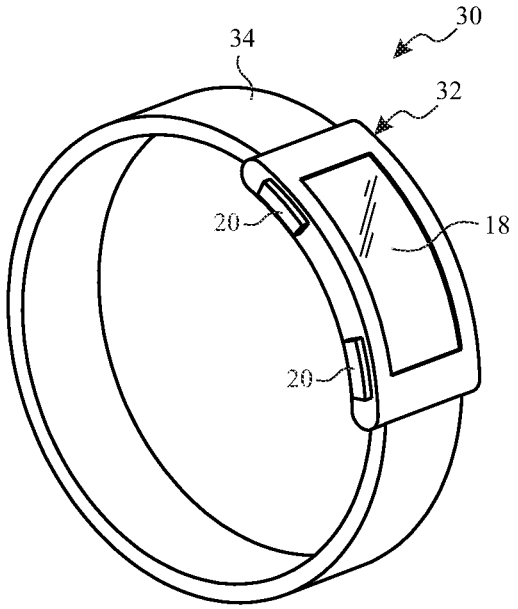
FIG. 2 is a perspective view of the electronic device in the form of a fitness band, in accordance with an embodiment.
Figure 3:
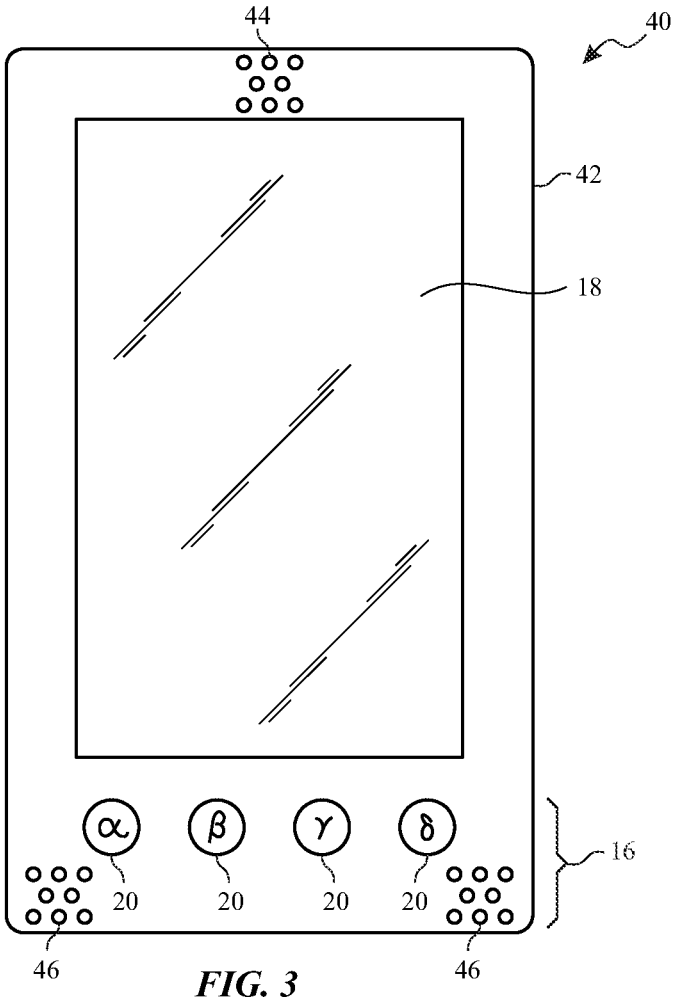
FIG. 3 is a front view of the electronic device in the form of a slate, in accordance with an embodiment.
Figure 4:
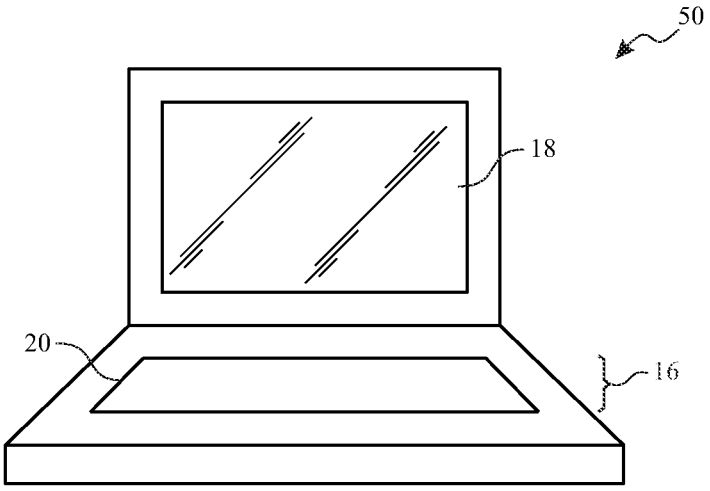
FIG. 4 is a perspective view of the electronic device in the form of a notebook computer, in accordance with an embodiment.

As may be appreciated, the electronic device 10 may take a number of different forms. As shown in FIG. 2, the electronic device 10 may take the form of a wearable electronic device, such as a fitness band 30. The fitness band 30 may include an enclosure 32 that houses the electronic device 10 components of the fitness band 30. A strap 34 may allow the fitness band 30 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 to navigate a graphical user interface (GUI) on the display 18.

The electronic device 10 may also take the form of a slate 40. Depending on the size of the slate 40, the slate 40 may serve as a handheld device, such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired or wireless connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
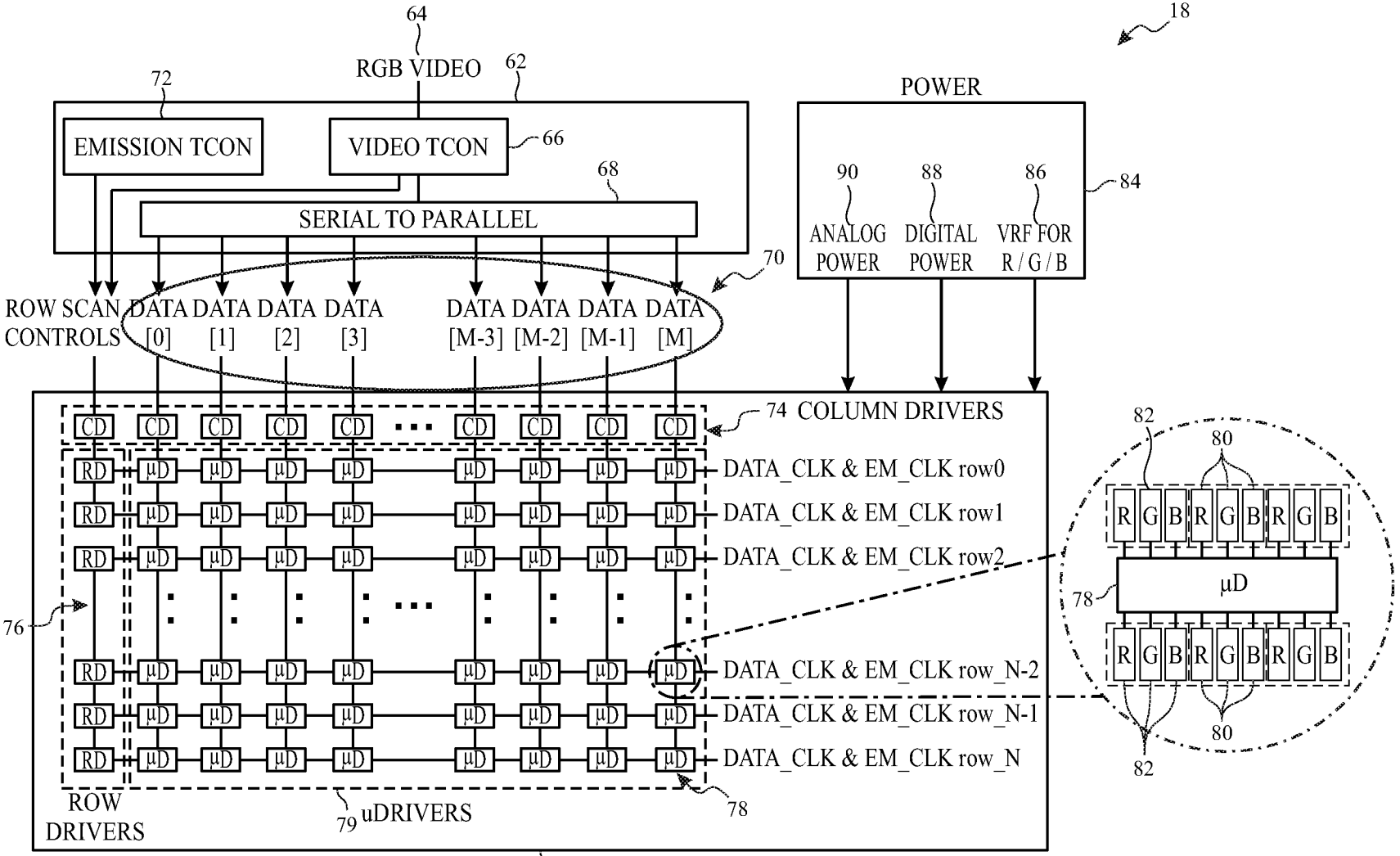
FIG. 5 is a block diagram of a μ-LED display that employs microdrivers (μDs) to drive μ-LED subpixels with controls signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial bus to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[ ], DATA[1], DATA[ ], DATA[3] DATA[M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs or uDs) 78. The uDs 78 are arranged in an array 79. Each uD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the uDs 78 of FIG. 5 are shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, subpixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate time to activate the row of μDs 78 driven by the RD 76. A row of μDs 78 may be activated when the RD 76 that controls that row sends the data clock signal (DATA_CLK). This may cause the now-activated μDs 78 of that row to receive and store the digital image data 70 signal that is driven by the column drivers (CDs) 74. The μDs 78 of that row then may drive the pixels 80 based on the stored digital image data 70 signal based on the emission clock signal (EM_CLK). Although the illustrated embodiment shows only a single column of RDs 76, in some embodiments, the display panel 60 may include two or more RDs 76, such as a column of RDs 76 located at opposite ends of the array 79 of the μDs 78.

Figure 6:
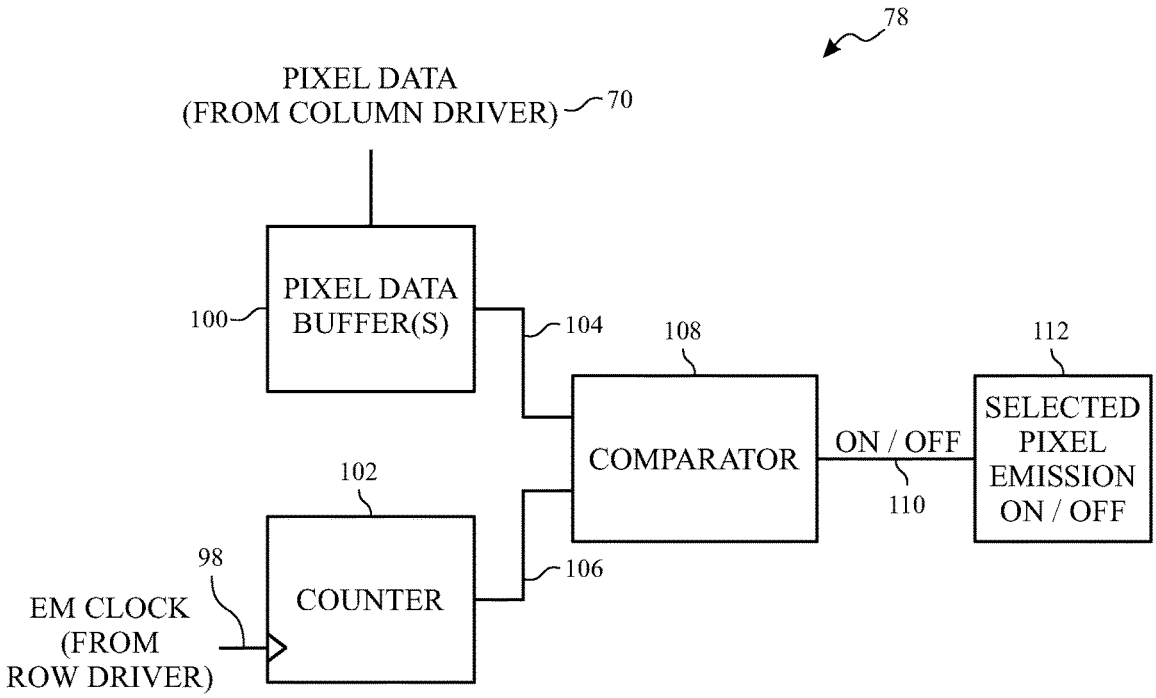
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
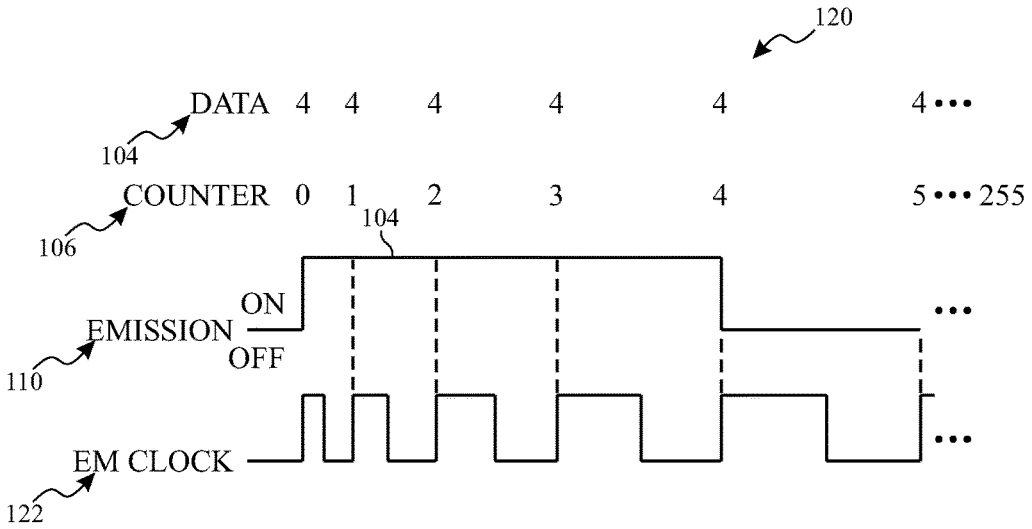
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are reflected by the steps between emission clock signal (EM_CLK) edges. That is, based on the way humans perceive light, to notice the difference between lower gray levels, the difference between the amounts of light emitted between two lower gray levels may be relatively small. To notice the difference between higher gray levels, however, the difference between the amounts of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

Figure 8:
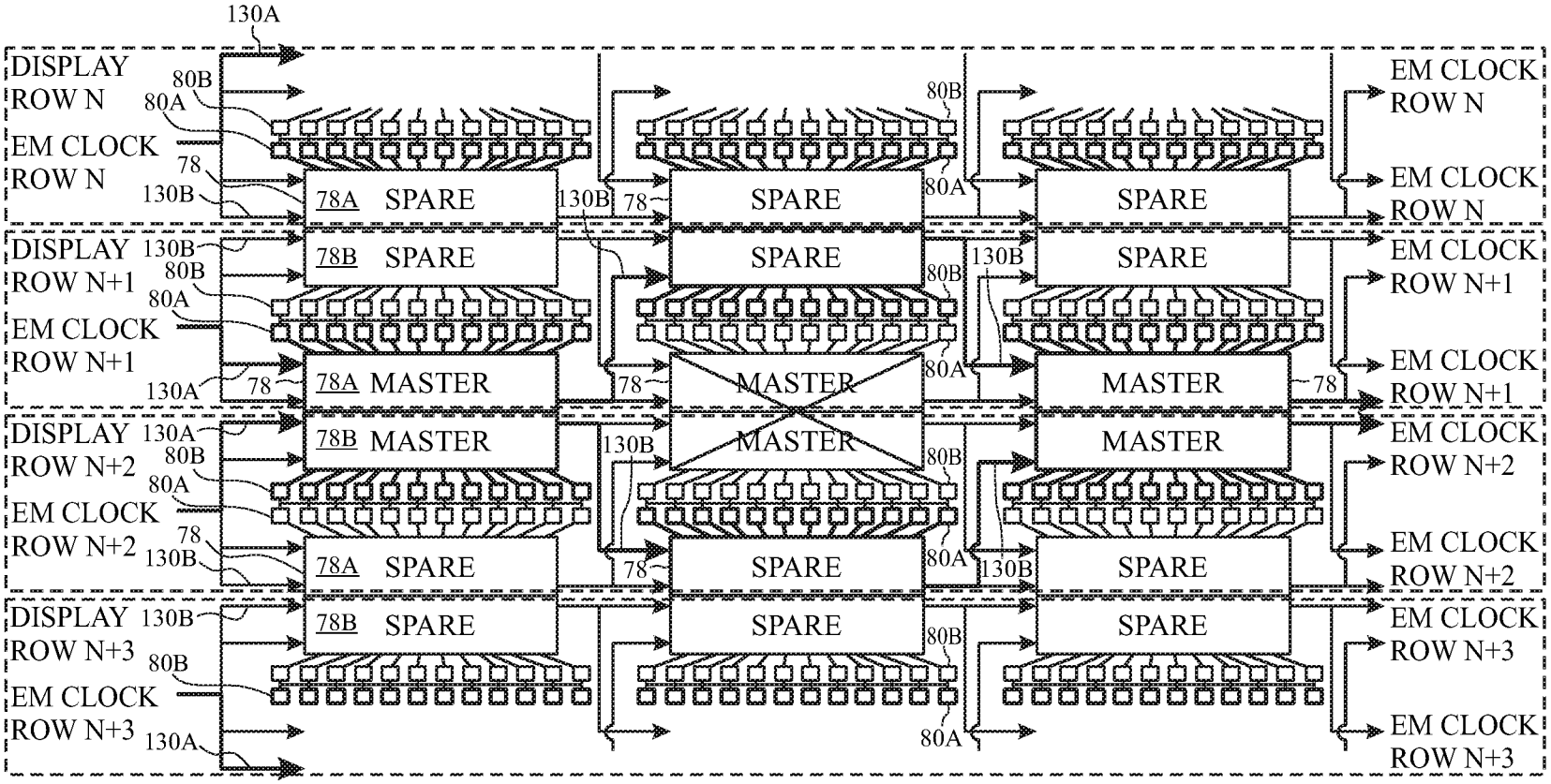
FIG. 8 is a detailed view a section of a μD array illustrating an example of an emission clock distribution and redundancy scheme.

It should be appreciated that since each μD 78 is a small integrated circuit that is typically placed on the display panel 60 by a pick-and-place machine so that the μD 78 can make the appropriate connections with the plurality of sub-pixels 72 which are similarly placed on the display panel 60. Occasionally, some of the μDs 78 do not function properly. Hence, as illustrated in FIG. 8, each μD 78 may include a pair of μD circuits 78A and 78B, each of which is configured to drive a separate set of pixels 80A and 80B, respectively. As shown in FIG. 8, the μD 78 may be arranged such that one row of μDs 78 may be designated as the primary or master drivers, while alternating rows may be designated as secondary or spare drivers that would typically only be used if the primary or master driver failed. The separate sets of pixels 80A and 80B may be arranged adjacent to one another so that if the master μD 78 fails and cannot drive its set of pixels 80A, the spare μD 78 may be used to drive the set of pixels 80B. Because the separate sets of pixels 80A and 80B are located adjacent to one another, the human eye cannot discern that there is any ambiguity in the image that is produced.

However, as mentioned above, while this redundancy scheme ultimately facilitates the production of a fully functional μLED display 18, any unused components, particularly redundant μLED pixels 80, unnecessarily increase the cost of the μLED display 18. The various testing techniques described below may be performed on the panel 18 prior to the placement and bonding of any of the μLED pixels 80. Furthermore, the testing techniques described below are capable of pinpointing specific defective elements, such as defective μDs 78 and defective μLED pixels 80. Once the defective drivers and μDs 78 are detected, the μLED pixels 80 may be placed and bonded only on functional μDs 78 in rows that do not include a defective row driver 76. Indeed, as described in greater detail below, because the present testing techniques utilize a parallel as opposed to a serial testing architecture, not only are the present testing techniques capable of pinpointing specific defective row drivers 76 and μDs 78, they also require fewer test pins, thus leading to an overall reduction in pin count on the backplane of the display panel 18. Furthermore, as is discussed below, because at least some of the pins used in a testing mode are reused from an operation mode, the additional testing pin count for the μDs 78 may be kept relatively low.

Furthermore, in some testing methods, the testing results depend on the functionality of the tester, functionality of the row drivers, functionality of the row drivers, and timing of the system. The resultant test data may be convoluted from the functionality variability of all of the components. In some cases, it may be rather difficult to distinguish the functionality of the system components from each other to get to a root cause of a detected problem. To address this issue, row driver functionality may be bypassed by using pins of the μDs 78 to control testing modes using a voltage shipped to the μDs 78. Moreover, functionality testing may be restricted to the μDs 78 and the μLED pixels 80 to pinpoint functionality issues. For example, if more than a threshold (e.g., 1, 2, 3, 4, or more) μLED pixels 80 coupled to a μD 78 has failed, the problem may be more likely correlated to the respective μD 78 that the connected μLED pixels 80. Moreover, in some embodiments, individual μDs 78 may be controlled to pinpoint accuracy. However, in certain embodiments, such individual testing may be eschewed for speed of parallel testing. In some embodiments, a hybrid scheme may be used such that if a detected luminance is below expectation, a more precise scan may be employed thereafter.

Figure 9:
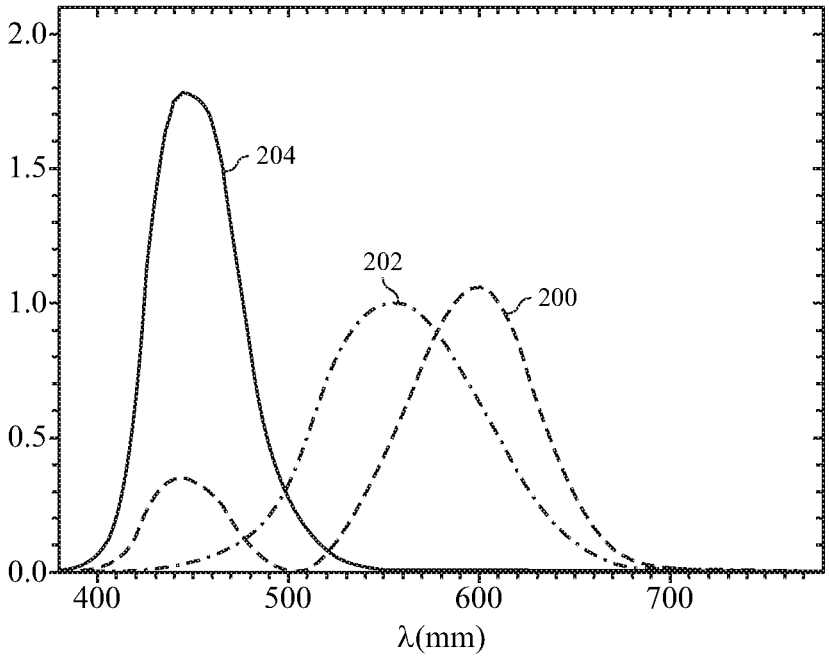
FIG. 9 is a graphical view of a frequency spectrum of colors displayed by the display of FIG. 1, in accordance with an embodiment.

In some embodiments, each color may be tested individually. Alternatively, some testing may be conducted for more than a single color at a time. Such testing may be performed using optical filters. FIG. 9 illustrates an embodiment of a filtering scheme that may be used to test operation of μDs 78 and μLED pixels 80. The filtering scheme includes a red filter 200, a green filter 202, and a blue filter 204 that indicate what values should be afforded incoming light using optical filtration. Using these filters, at least some LEDs (e.g., blue and green) may be tested simultaneously since the resulting measured values are unlikely to be improperly conflated. By combining color testing, pin counts may be further reduced in addition to possible increase speed of analysis with parallel color μLED pixel 80 analysis.

Figure 10:
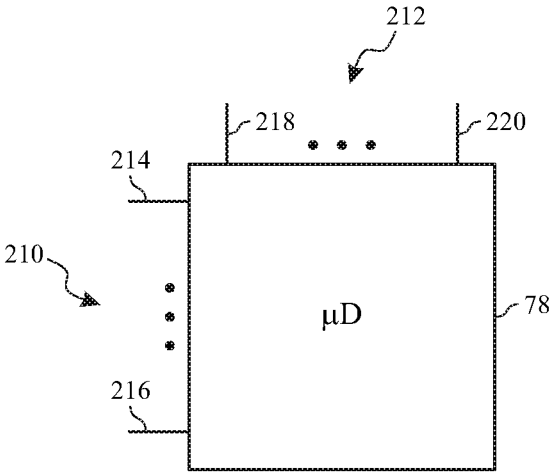
FIG. 10 illustrates a portion of a μD pinout utilizing an embodiment of a testing technique, in accordance with an embodiment.

FIG. 10 illustrates an embodiment of a μD 78 that has operational pins 210 and scanning pins 212. As illustrated, the operation pins 210 include a first operation pin 214 and a second operational pin 216. The operational pins 210 may include pins used to transfer data into the μD 78 during operation of the μD 78 or enable a partial update of the μD 78. In some embodiments, the number of operational pins 210 used to operate the μD 78 may vary from two to include one, two, three, or more pins that are used to operate the μD 78 during an operation mode. Similarly, the illustrated embodiment of the testing pins 212 includes a first scanning pin 218 and a second scanning pin 220. For example, the first scanning pin 218 may include a scanning mode enable pin that indicates that a scanning mode is to be enabled when the signal is at a preset value (e.g., logic high or 1), and the second scanning pin 220 may indicate a scan type pin that may have a preset value (e.g., 0) that indicates the testing mode. In some embodiments, the number of testing pins 212 used only for scanning modes for the μD 78 may vary from two to include one, two, three, or more pins that are used to only to test the μD 78 during a testing mode.

Table 1 below illustrates an embodiment of values that may be used to set modes for the μD 78.

TABLE 1

| Pin Operation Modes | | | | |
|---|---|---|---|---|
| Mode | Scan_Enable | Scan_Mode | Data | Partial_Update_En |
| Functional | 0 | 0 | Functional data | |
| Scan Shift | 1 | 1 | Scanin | Scanout |
| Scan Capture | 0 | 1 | Scanin | Scanout |
| Light Up Red Slice 0 | 1 | 0 | 0 | 0 |
| Light Up G/B Slice 0 | 1 | 0 | 0 | 1 |
| Light Up Red Slice 0 | 1 | 0 | 1 | 0 |
| Light Up G/B Slice 0 | 1 | 0 | 1 | 1 |

Figure 11:
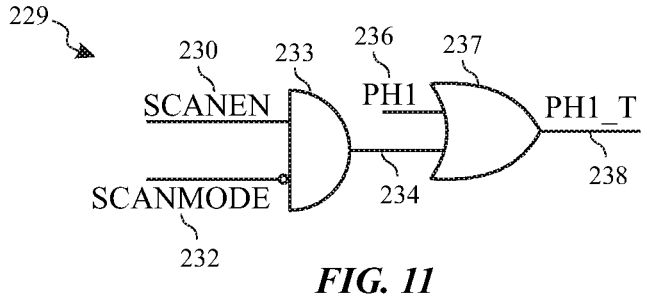
FIG. 11 illustrates a logic circuit for determining testing mode engagement for a μD, in accordance with an embodiment.

FIG. 11 illustrates an embodiment for a circuit 230 in the μP 78 for deriving a testing mode signal from the Scan_En signal 230 and the Scan_Mode signal 232. By inverting the Scan_Mode signal 232 before submission to an AND gate 233, a testing mode signal 234 is used to set the display in a testing mode. Additional scanning techniques (e.g., DFT) may be used in conjunction with the scanning test mode. For example, a PH1 signal 236 may indicate whether another testing mode has been enabled. Thus, an OR gate 237 may be used to determine whether a testing mode is to be activated from the testing mode signal 234 or PH1 signal 236. When the testing mode is to be activated, a PH1 T 238 signal is active.

Figure 12:
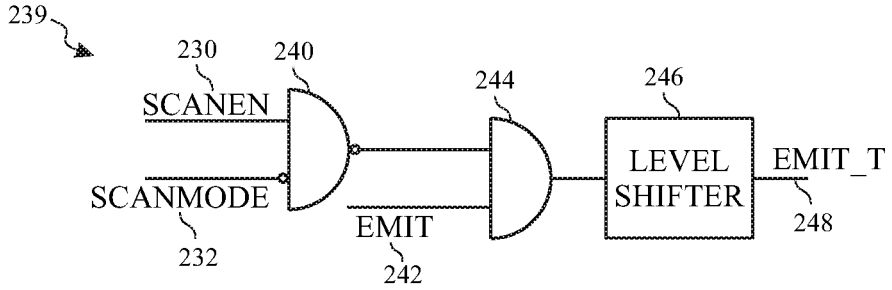
FIG. 12 illustrates a logic circuit for determine emission of a μD, in accordance with an embodiment.

FIG. 12 illustrates an embodiment for a circuit 239 used to control emission of the μD 78 in an emission state. The circuitry 239 receives the Scan_En signal 230 and the Scan_Mode signal 232 and generates an inverse of the testing mode signal 234. In the illustrated embodiments, the Scan_En signal 230 and the Scan_Mode signal 232 signals are submitted to a NAND gate 240, to generate a signal opposite of the testing mode signal 234 that indicates that testing is not being performed. This inverse scanning signal is submitted, along with an emission signal 242, to an AND gate 244 that is used to cause a logic high only when the emission signal 242 is a logic high and the μD 78 is not in a testing mode. The emission signal passed out of the AND gate 244 is then submitted to a level shifter 246 so that a shifted emission signal 248 is created for use in driving emission of the LED pixels 80 to a level for use in the LED pixels 80.

Figure 13:
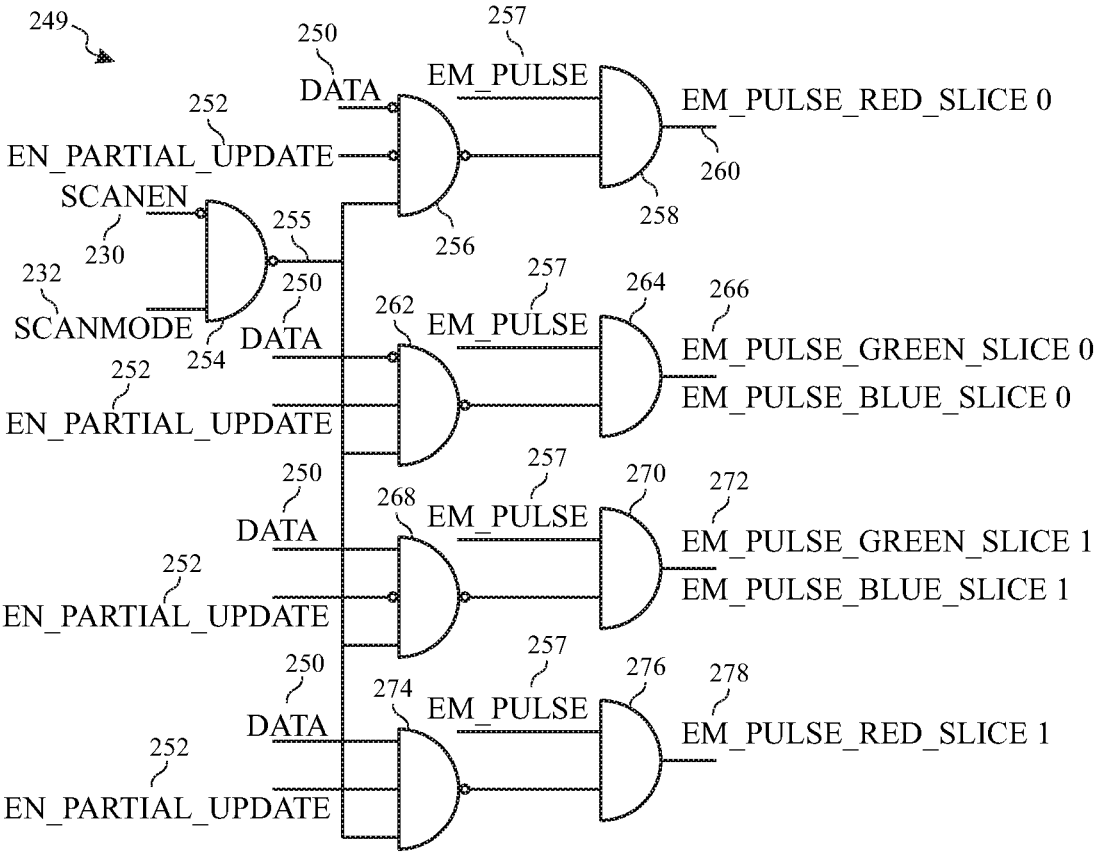
FIG. 13 illustrates a logic circuit for deriving pulse emission signals for slices and colors of the μD, in accordance with an embodiment.

FIG. 13 illustrates circuitry 249 for generation of emission pulses corresponding to the pixels being tested. The circuitry 249 receives Scan_En signal 230 and the Scan_Mode signal 232 as well as a Data signal 250 and an enable partial update signal 252. The data signal 250 may be used for image data during operation of the display in a normal display operation mode as illustrated in Table 1. The Scan_En signal 230 and the Scan_Mode signal 232 signals are used by a NAND gate 254 to generate a testing mode signal 255. It should be noted that, the testing mode signal 255 is inverse of the testing mode signal 234 since the testing mode signal 255 is later submitted to NAND gates rather than AND gates. The NAND gate 256 generates a signal that indicates that one color (e.g., red) LEDs in a first slice of LEDs corresponding to a μD 78 are to be tested. However, this testing may be delayed until an emission pulse signal 257 goes to a logic high. Accordingly, an AND gate 258 may be used to determine when the red LEDs of a first slice are to be tested and the emission pulse signal 257 is a logic high to generate a EM_Pulse_RED_Slice® 260 signal that indicates exactly when the LEDs are to be tested.

The NAND gate 262 generates a similar signal indicating when a testing mode for another color (e.g., blue and green) is to be tested. This signal is then combined with the emission pulse signal 257 to determine exactly when the other color pixels are to be tested. Thus, when the other pixels are blue and green, an EM_Pulse_Green_Slice® signal 266 or EM_Pulse_Blue_Slice® signal 268 may be generated. Although the illustrated embodiment discloses a combination of the blue and green pixels during a single testing phase, some embodiments may have different testing phases. Furthermore, although the foregoing discusses RGB pixel arrangements, additional or alternative pixel arrangements may be deployed, such as white pixels or other additive color models other than RGB.

The NAND gate 268 works similar to the NAND gate 262 instead indicating that a second slice of other colors LEDs 80 are to be tested. This signal is then combined with the emission pulse signal 257 by an AND gate 270 to generate an EM_Pulse_Green_Slice1 signal 272 or EM_Pulse_Blue_Slice1 signal 272.

The NAND gate 274 works similar to the NAND gate 250 instead indicating that a second slice of red LEDs 80 are to be tested. This signal is then combined with the emission pulse signal 257 by an AND gate 276 to generate an EM_Pulse_RED_Slice1 278. Although the foregoing illustrates circuitry using AND, OR, and/or NAND logic, such logic may be implemented using alternative implementations such as different logic or circuitry to achieve similar results.

Figure 14:
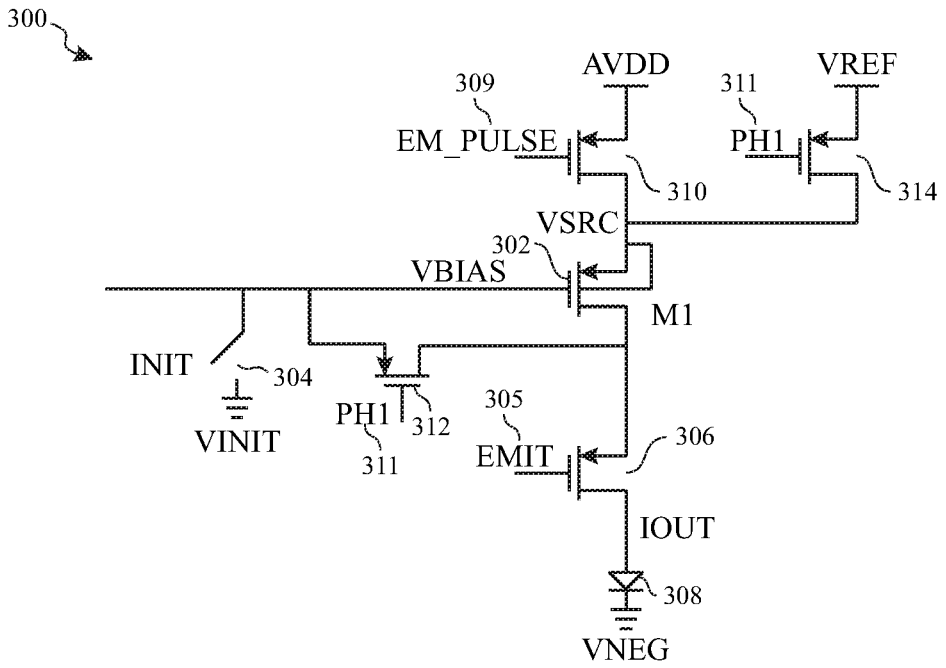
FIG. 14 illustrates a circuit for implementing the logic circuits of FIGS. 11-13 using an analog voltage pin, in accordance with an embodiment.

FIG. 14 illustrates a circuit 300 that includes a transistor 302 that sets a value of current driven to determine an output level of pixels of a display. Specifically, as illustrated, the transistor 302 may be oriented in an enhancement mode with a gate coupled to an analog voltage pin 304 that provides a variable current to the transistor 302. The illustrated embodiment of the transistor 302 includes an NMOS transistor, but alternative transistor types may be used to vary current to determine pixel output, such as PMOS, JFET, or other suitable transistors. When the voltage increases at the gate, the gate-to-source voltage (VGs) increases and the drain current increases, when an emit signal 305 is a logic high. As illustrated, the drain of the transistor 302 is coupled to an emission transistor 306 that causes emission of an LED 308 when the emit signal 305 is a logic high and current is supplied from the transistor 302. The current (Tout) through the emission transistor 306 controls a level of luminance of the LED 308.

The circuit 300 also receives an EM_Pulse signal 309 (similar to the signal 257) that controls when testing mode emission is performed. The EM_Pulse signal 309 toggles connection of the transistor 310 to AVDD depending on whether the EM_Pulse 309 is a logic high or a logic low. The circuit 300 also receives a PH1 signal 311 that indicates whether the display is undergoing an auxiliary testing mode (e.g., DFT). The PH1 signal 311 causes a transistor 312 to bypass the transistor 302 by shorting the drain and gate of the transistor 302 to render the transistor 302 to effectively act as a diode. In some embodiments, bypass of the enhancement during the auxiliary testing mode is used since the enhancement mode of the transistor 302 is used for pin-induced testing and/or ordinary operation. The PH1 signal 311 also supplies a signal that provides a reference voltage via transistor 314 during the auxiliary testing.

Figure 15:
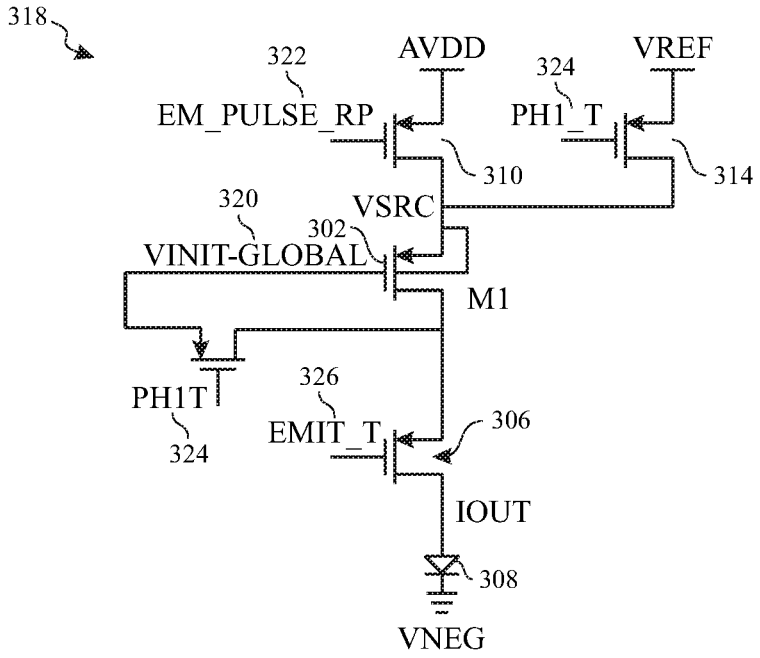
FIG. 15 illustrates a circuit for implementing the logic circuits of FIGS. 11-13 using an dedicated voltage by color, in accordance with an embodiment.
Figure 16:
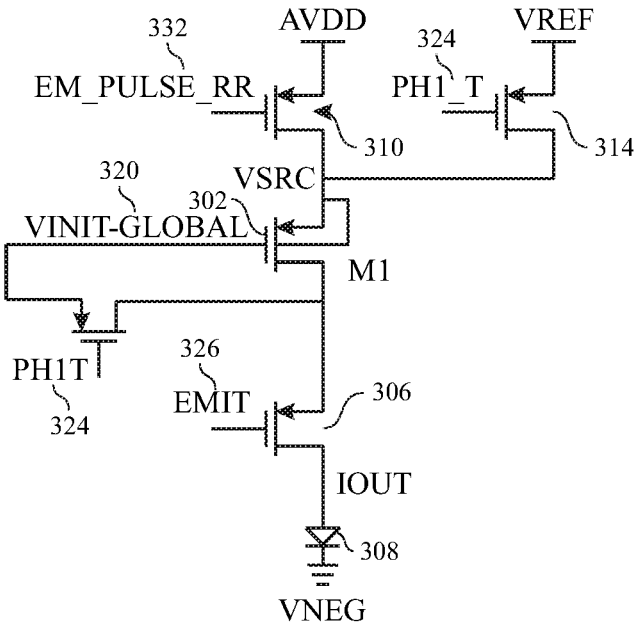
FIG. 16 illustrates a circuit for implementing the logic circuits of FIGS. 11-13 using an additional dedicated voltage for another color other than that used in FIG. 15, in accordance with an embodiment.

FIG. 15 illustrates a circuit 318 that is similar to the circuit 300. However, the circuit 318 does not include an analog voltage pin. Instead, the circuit 318 includes a global voltage 320 that may be applied for one color (e.g., red) that controls drain current of the transistor 302 the emits based on an EM_Pulse signal 322, PH1_T signal 324, and EMIT_T signal 326. FIG. 16 illustrates a circuit 330 that is similar to the circuit 318 except that the circuit 330 is used to driver another color of pixels (e.g., blue and/or green) using a different voltage for the global voltage 320 and using a different EM_Pulse signal 332.

Figure 17:
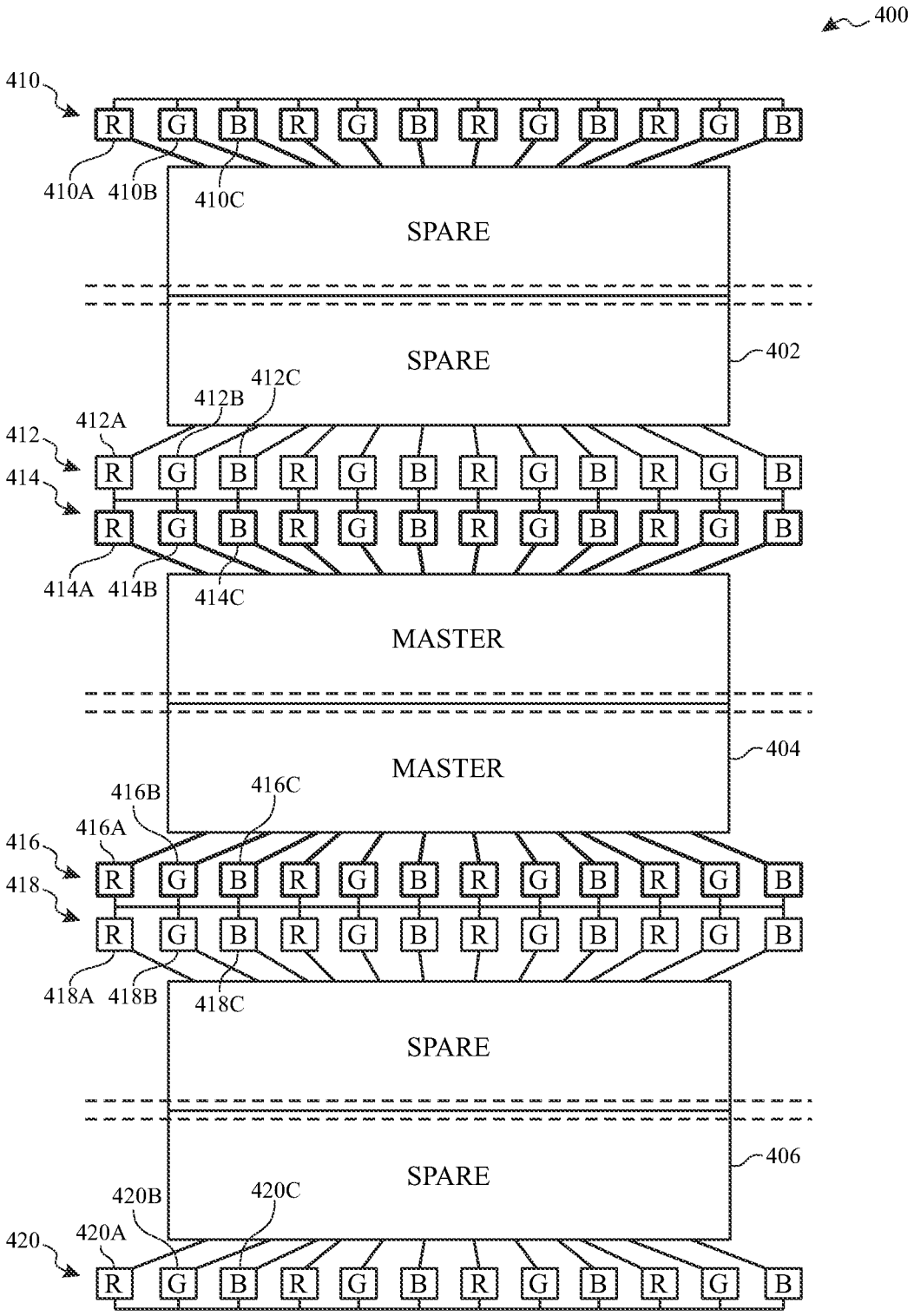
FIG. 17 illustrates an example of a portion of the display having redundant microdrivers each having redundant LEDs coupled thereto in slice orientations, in accordance with an embodiment.

FIG. 17 illustrates an embodiment of a portion 400 of the display 18 illustrating μdrivers 402, 404, and 406. Some of the μdrivers of the display 18 are coupled to multiple slices of μpixel LEDs. For example, the μdriver 402 is coupled to a first slice 410 and a second slice 412, the μdriver 404 is coupled to a first slice 414 and a second slice 416, and the μdriver 406 is coupled to a first slice 418 and a second slice 420. One of the slices coupled to each μdriver may be a row of primary LEDs and a row of secondary LEDs with the secondary LEDs being used when a corresponding primarily LED has is defective or has failed. Each slice may be divided into multiple colors. For examples, the slices 410, 412, 414, 416, 418, and 420 are divided in to alternating red, green, and blue colors. In some embodiments, these colors may be arranged differently. For example, the color order may repeat or be more irregular than the illustrated color order. Furthermore, in some embodiments, more colors may be included in a primary slice of a μdriver while more of other colors may includes in a secondary slice of the μdriver.

Moreover, the μdrivers may also be redundant. For example, the μdriver 402 may be redundant for a μdriver (not seen) that is above the μdriver 402, and the μdriver 406 may be redundant for the μdriver 404. The redundant μdrivers may become operational when a corresponding μdriver has at least partially failed or is defective.

Figure 18:
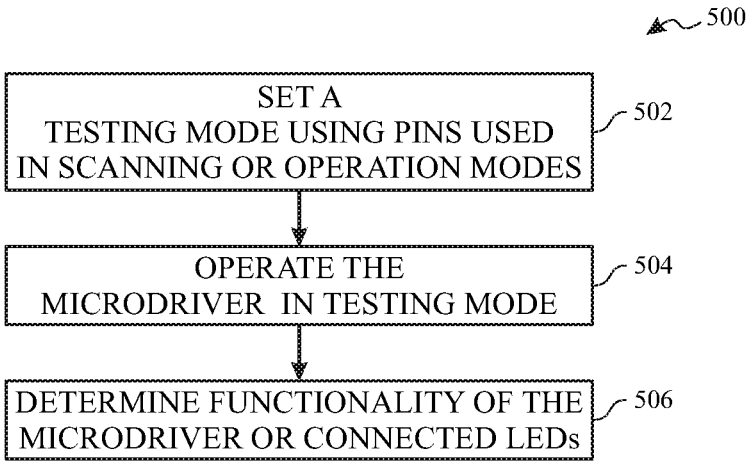
FIG. 18 illustrates a process for testing and operating a display using the present testing techniques, in accordance with an embodiment.

FIG. 18 illustrates an embodiment of a process 500 for testing a display 18. The process begins with a controller (e.g., TCON 66 or 72 and/or CPU 12) setting a testing mode using pins used in a scanning or operation mode (Block 502). For example, the pins may include a scanning mode pin configured to indicate a type of scan, a scan enable pin configured to enable scan modes of an array of microdrivers in the display 18, a data pin configured to provide image data to pixels coupled to the microdriver of the array of microdrivers, and/or a partial update enable pin that enables partial data updates to the microdriver during operation of the display 18.

The controller then operates the display 18 in the testing mode (Block 504). For example, the controller may drive pixels of a slice (e.g., a first half of pixels, a first color of pixels, etc.) to a testing level for determination of operation of the microdrivers and/or LEDs of the display 18. In some embodiments, more than one color (e.g., blue and green) may be tested simultaneously with optical filtering to determine operation of the microdrivers and/or the LEDS.

A determination is made, by the controller and/or a separate controller whether the microdrivers or the connected LEDs are functioning properly (Block 506). In some embodiments, this determination may be made from optical scans of the display. Additionally or alternatively, the driving circuitry currents and/or voltages may be measured to determine of an expected drop is occurring across the pixels that is expected when the LEDs and microdrivers are functioning properly.

As previously discussed, this testing may be performed prior to affixing the LEDs and/or the microdrivers to the display and, once functionality of the LEDs and the microdrivers have been confirmed the LEDs and microdrivers may be affixed to the display 18. In some embodiments, defective microdrivers and/or LEDs may be discarded and replaced by non-defective microdrivers and LEDs such that only non-defective microdrivers and LEDs may be affixed to the display at time of manufacture. Alternatively, mapping may be used to avoid defective microdrivers and/or LEDs to instead deploy spare microdrivers and/or LEDs in place of the defective microdrivers and/or LEDs regardless of when testing occurs.

Furthermore, classification may be made of failures. For example, if luminance of a portion of the display 18 is sufficiently below an expected value, closer examination may be performed. Specifically, individual LEDs may be tested to confirm exactly which LEDs have failed. If more than a threshold number of LEDs have failed, the failure may be attributed to the microdriver. If less than the threshold number of LEDs has failed, the failure may be attributed to the LEDs themselves.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Moreover, although the foregoing discusses row drivers that send data to microdrivers and column drivers that control which micro driver in a row receives the data, it should be appreciated that the foregoing discussion about row drivers may be applied to column drivers and vice versa merely by rotating orientation of the display. Thus, recitations of columns and rows may be interchangeable in meaning herein.

What is claimed is:

1. A method of testing a display having an array of microdrivers arranged in a plurality of rows and columns, comprising:

setting a testing mode of a microdriver of the array of microdrivers using a plurality of pins of the microdriver that are used in scanning or operation modes of the microdriver, wherein the microdriver is configured to light one or more connected micro light emitting diode pixels coupled to the microdriver during the testing mode;

operating the microdriver in the testing mode;

determining functionality of the one or more connected micro light emitting diode (microLED) pixels or the microdriver based on the testing mode; and disposing microLEDs on the display in connection with only microdrivers determined to be non-defective, wherein determining the functionality is performed prior to disposing any microLEDs on the display.

2. The method of claim 1, wherein determining the functionality of the one or more connected microLED pixels or the microdriver comprises optically scanning using an optical scanner the one or more connected microLED pixels.

3. The method of claim 2, wherein the one or more connected micro light emitting diode pixels are placed in an emission state simultaneously.

4. The method of claim 3, wherein the one or more connected micro light emitting diode pixels comprise a plurality of colors.

5. The method of claim 4, wherein the plurality of colors comprises green and blue.

6. The method of claim 4, wherein the optical scanner filters the plurality of colors into individual colors.

7. The method of claim 1, wherein determining functionality of the one or more connected microLED pixels or the microdriver based on the testing mode comprises:

attributing a failures of a number of micro LEDs less than a threshold to micro LED failure; and attributing failures of a number of micro LEDs greater than or equal to the threshold to a microdriver failure.

8. The method of claim 7, comprising the step of programming the display to avoid any defective microdrivers.

9. An electronic display comprising:

an array of microdrivers arranged in a plurality of rows and columns each microdriver having a plurality of pins to control operation of the microdriver in operating or scanning modes; and processing circuitry operably coupled to the array and being configured to:

set a testing mode of a microdriver of the array of microdrivers using the plurality of pins of the microdriver, wherein the microdriver is configured to light one or more connected micro light emitting diode pixels coupled to the microdriver during the testing mode;

operate the microdriver in the testing mode; and determine functionality of the one or more connected micro light emitting diode pixels or the microdriver based on the testing mode, wherein the micro light emitting diode pixels are coupled only to microdrivers determined to be non-defective.

10. The electronic display of claim 9, wherein the processing circuitry is configured to determine whether any microdrivers have failed based at least in part on optically scanned data.

11. The electronic display of claim 9, wherein the processing circuitry comprises a timing controller.

12. The electronic display of claim 9, wherein the processing circuitry is configured to perform the recited steps prior to any microLEDs being disposed on the display.

13. The electronic display, as set forth in claim 9, wherein the processing circuitry is configured to program the display to avoid any defective microdrivers.

14. An electronic device comprising:

a processor; and an array of microdrivers each microdriver having a plurality of pins to control operation of the microdriver in operating or scanning modes; and display processing circuitry operably coupled to the array and configured to:

set a testing mode of a microdriver of the array of microdrivers using the plurality of pins of the microdriver, wherein the microdriver is configured to light one or more connected micro light emitting diode pixels coupled to the microdriver during the testing mode;

operate the microdriver in the testing mode; and determine functionality of the one or more connected micro light emitting diode pixels or the microdriver based on the testing mode, wherein micro light emitting diodes are only disposed on microdrivers determined to be non-defective.

15. The electronic device of claim 14, wherein the plurality of pins comprises:

a scan enable pin configured to enable scan modes of the array; and a scan mode pin configured to set a scan mode of a plurality of scan modes, wherein the plurality of scan modes includes the testing mode.

16. The electronic device of claim 14, wherein the plurality of pins comprises:

a data pin configured to receive data during the operating mode of the array; and a partial update enable pin that enable partial data updates to the microdriver during the operating mode of the array.

17. The electronic device of claim 14, wherein the display processing circuitry is configured to program the display to avoid any defective microdrivers.

18. The electronic device of claim 17, wherein avoiding any defective microdrivers comprises using a redundant microdriver in place of the defective microdriver.

* * * * *